United States Patent [19]

Pogharian et al.

[11] Patent Number: 4,458,392

[45] Date of Patent: Jul. 10, 1984

[54] JEWELRY CLASP

[76] Inventors: Mardig V. Pogharian; Vahan M. Pogharian, both of 8513 Fullbright Ave., Canoga Park, Calif. 91306

[21] Appl. No.: 316,295

[22] Filed: Oct. 29, 1981

[51] Int. Cl.[3] ..... A44B 17/00

[52] U.S. Cl. ..... 24/664

[58] Field of Search ..... 24/217 R, 219, 255 SL, 24/220, 206, 234, 235, 211 M, 211 L; 59/93; 63/7, 11, 15.45, 15.5, 15.65

[56] References Cited

U.S. PATENT DOCUMENTS

| | | | |
|---|---|---|---|
| 215,956 | 5/1879 | Miller | 63/11 |
| 346,811 | 8/1886 | Drew | 24/235 X |
| 1,278,783 | 9/1918 | Stoner | 24/206 R |
| 1,409,138 | 3/1922 | Fontana | 63/15.5 |
| 1,439,812 | 12/1922 | Goodrich | 24/206 R |
| 1,823,043 | 9/1931 | Heugas | 24/206 R |
| 2,896,288 | 7/1959 | Davis | 24/211 M |
| 2,902,738 | 9/1959 | Owens | 24/217 |

FOREIGN PATENT DOCUMENTS

| | | | |
|---|---|---|---|
| 51892 | 5/1889 | Fed. Rep. of Germany | 63/15.5 |
| 35972 | 12/1929 | France | 34/206 R |

*Primary Examiner*—F. Barry Shay

*Attorney, Agent, or Firm*—John Joseph Hall

[57] ABSTRACT

A jewelry clasp having a female member with parallel sides and a bottom, a top member mounted at its inner end to said sides of the female member, and having a pull-up lever on its surface at its outer end and a stop member under the pull-up lever, and a male member having a planar shape with a groove along one side.

3 Claims, 5 Drawing Figures

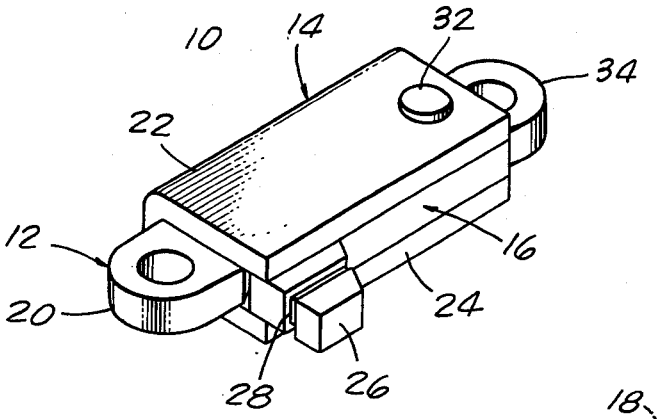
FIG. 1.
FIG. 2.
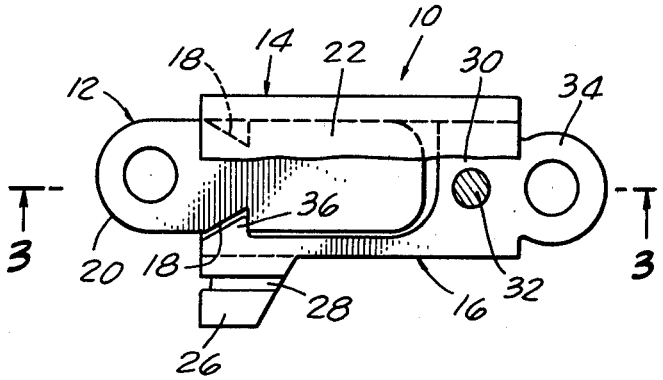
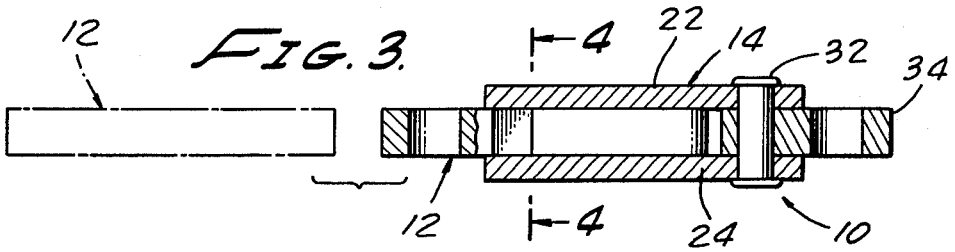
FIG. 3.
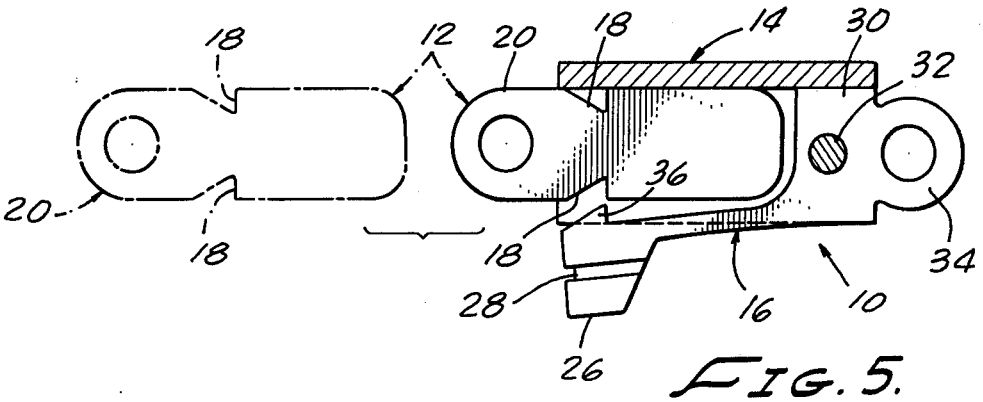
FIG. 5.
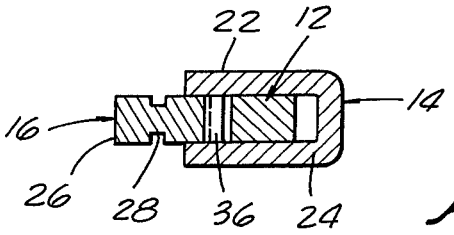
FIG. 4.

JEWELRY CLASP

SUMMARY OF THE INVENTION

Although jewelry clasps having male and female members are known in the prior art, such jewelry clasps are made up of many component parts and are difficult to use in manufacture. Many of such conventional jewelry clasp require the use of a spring.

The present invention provides an improved jewelry clasp dispensing with the need of spring means, and is comprised of only three parts, a male member, a female member, and a top member.

The male member is formed into a tongue-like shape with a planar top and bottom having a groove along a side towards its outer end.

The female member has parallel sides and a bottom formed integrally and preferably from a single piece of material. A top member forming the top of the female member is provided with an integrally formed pull-up lever at its outer end and an integrally formed stop member under the surface of the top member. The top member is inserted in the compartment formed by the female member and secured therein by a pin. The invention provides a secure clasp for various kinds of jewelry, and yet has only three parts which can be easily manufactured. These parts are not subject to damage easily, and dispenses with the use of a spring as well as other component parts of conventional jewelry clasps.

It is therefore, an object of this invention to provide a reliable and convenient jewelry clasp of the male member and female member type.

Another object of this invention is to provide a jewelry clasp which is relatively easy to manufacture and to use.

A further object of this invention is to provide a jewelry clasp which dispenses with the need of a spring and other component parts and conventional jewelry clasps.

These and other objects will be more readily understood by reference to the accompanying drawing of the preferred embodiment, in which:

FIG. 1 is a perspective view of the invention in a locked position.

FIG. 2 is a side elevational section of view of the invention.

FIG. 3 is a view taken along line 3—3 of FIG. 2 and also shows the removal of the male member.

FIG. 4 is a view taken along line 4—4 of FIG. 3.

FIG. 5 is a view similar to FIG. 3 showing the removal of the male member.

The jewelry clasp 10 has a male member 12, a female member 14, and a top member 16. The male member 12 has a planar top and bottom surface with a groove 18 along each of its sides near its outer end, which is provided with a ring 20. The inner end of the male member 12 is preferably rounded.

The female member 14 has parallel sides 22 and 24, preferably formed from a single piece of material to define a compartment therein. The top member 16 is provided with an integrally formed pull-up lever 26 and its outer portion, with a longitudinally groove 28 on each side. The inner portion of lever 26 is formed into a support member 30 and is fixed to the female member by pin 32. A ring 34 is mounted at the inner end top member 16.

The top member 16 is provided with a stop member 36 integrally formed under the surface of top member 16 and located in the outer end of top member 16.

Any material having the strength and resilience to carry out the required performance of jewelry clasp 10 may be used, such as a suitable gold alloy or stainless steel, and the like.

In operation, the male member 12 is inserted into the female member 14 until stop member 36 of top member 16 engages groove 18 of male member 12, which locks the jewelry clasp 10.

To unlock jewelry clasp 10, pull-up lever 26 is moved outwards, disengaging stop member 36 from groove 18 of male member 12. Longitudinal grooves 28 of pull-up lever 26 facilitate the outward movement of lever 26. In this manner, the jewelry clasp 10 is unlocked as desired.

Although I have described a preferred embodiment of my invention, it is understood that numerous changes in construction and arrangement of the parts may be made within the spirit and scope of my invention as hereinafter claimed.

We claim:

1. A jewelry clasp comprising:

a male member having parallel side edges and a generally oblong planar form, with a groove formed in one of its side edges;

a planar female member receiving said male member, said female member having integrally formed parallel planar side walls spaced apart a distance only slightly greater than the thickness of said male member and a bottom wall, defining a generally U-shaped compartment open at its upper end; and a top member sandwiched between said parallel side walls of said generally U-shaped female member and extending from said bottom wall to the top edges of said side walls, said top member including a support member portion on its inner end that is fixed to the inner ends of said side walls, said top member having a pull-up lever portion integrally formed with said support member portion and extending forwardly therefrom in spaced relation from said bottom wall, said pull-up lever portion being resiliently moveable relative to said side walls, and together with said side walls and said bottom wall defining a chamber for receiving said male member, the outer end of said pull-up lever projecting upwardly from said female member, and the underside of the outer end of said pull-up lever portion having a stop member integrally formed thereon, for engaging said groove of said male member to lock said jewelry clasp, said male member being released from said female member by grasping said outwardly projecting portion of said pull-up lever and deflecting it away from said female member to release said stop member.

2. A jewelry clasp according to claim 1 in which said male member has a groove on each side.

3. A jewelry clasp according to claim 1 in which said pull-up lever has a longitudinal groove on each of its sides.

* * * * *